US006179270B1

(12) United States Patent
Higdon

(10) Patent No.: US 6,179,270 B1
(45) Date of Patent: Jan. 30, 2001

(54) PORTABLE DRIVE ASSEMBLY FOR A MANUAL CHAIN HOIST

(76) Inventor: Robert Higdon, 1415 Fulcher Rd., Franklin, NC (US) 28734

( * ) Notice: Under 35 U.S.C. 154(b), the term of this patent shall be extended for 0 days.

(21) Appl. No.: 09/413,331

(22) Filed: Oct. 12, 1999

(51) Int. Cl.[7] ..... B66D 3/16
(52) U.S. Cl. ..... 254/358; 254/359; 254/362
(58) Field of Search ..... 254/358, 359, 254/362, 372

(56) References Cited

U.S. PATENT DOCUMENTS

| | | | | |
|---|---|---|---|---|
| 665,210 | * | 1/1901 | Griffin et al. | 254/358 |
| 756,454 | * | 4/1904 | Astrup | 254/358 |
| 1,288,137 | * | 12/1918 | Newhall, Jr. | 254/372 |
| 1,468,916 | * | 9/1923 | Newhall et al. | 254/343 |
| 4,151,981 | * | 5/1979 | Gennep | 254/362 |
| 4,962,901 | * | 10/1990 | Shirley et al. | 242/323 |
| 5,738,340 | * | 4/1998 | Brantner | 254/362 |
| 5,871,069 | * | 2/1999 | Carmitchel | 254/362 |
| 5,996,971 | * | 12/1999 | Crouse | 254/362 |

* cited by examiner

*Primary Examiner*—Katherine A. Matecki
(74) *Attorney, Agent, or Firm*—Coats & Bennett, PLLC

(57) ABSTRACT

A portable drive assembly for driving a chain hoist which includes a drive sheave having a drive shaft extending therefrom that is adapted to be connected to a portable power drill. The drive sheave includes a chain cavity extending around the same for engaging and driving the drive chain associated with a manual chain hoist. To stabilize the portable drive assembly during operation, a stirrup extends from the assembly and the operator is able to stabilize the portable drive assembly by projecting his or her foot into the stirrup. Thus the chain hoist is driven, in either direction, by simply actuating the power drill and holding the portable drive assembly such that the drive sheave continuously engages a lower run of the drive chain.

12 Claims, 2 Drawing Sheets

PORTABLE DRIVE ASSEMBLY FOR A MANUAL CHAIN HOIST

FIELD OF THE INVENTION

The present invention relates to chain hoists and more particularly to a portable drive assembly for driving the drive chain of a chain hoist.

BACKGROUND OF THE INVENTION

Chain hoists are widely used throughout the world to lift and lower heavy objects. Basically, a chain hoist includes a load chain that is designed to connect to the load and a drive chain that is operative to raise and lower the load chain and the load connected thereto. The chain hoist includes a reduction gear network that is operatively connected between the drive chain and the load chain. Thus, very heavy loads can be moved upwardly or downwardly by a relatively small amount of force.

Many of the chain hoists that are operating today are of the manual drive type. That is, the drive chain is manually pulled by a person as opposed to the newer chain hoists that are electrically driven. Surprisingly, there are large numbers of manual hoists in existence and being used today. The amount of energy required to drive these chain hoists is substantial. This is particularly true in applications where individuals operating these manual chain hoists are required to repeatedly and continuously manually drive them. It is not unusual for this strenuous work over time to result in back and other injuries.

It is known, however, to provide chain hoists with electric drives. For example, in the patent to H. B. Newhall, U.S. Pat. No. 1,468,916, there is shown a chain hoist that is powered by an electric motor. However, the electric motor is mounted on a frame and suspended from the drive chain by a pulley or drive member that is driven by an interconnecting gear network. In the end, such drive systems are heavy, bulky and certainly difficult to transport from one location to another.

Therefor, there has been and continues to be a need for a portable light weight power assembly for driving manual chain hoists that can be easily transported from one location to another.

SUMMARY OF THE INVENTION

The present invention entails a portable drive assembly for driving a manual chain hoist. As a part of the portable drive assembly, there is provided a drive sheave that includes a chain drive cavity formed around the sheave that is adapted to engage and drive a drive chain that forms a part of a manual chain hoist. Extending from or through the drive sheave is a drive shaft that is particularly adapted to connect to a portable power drill. By actuating the power drill, the drive sheave is driven, and when the drive sheave is maintained in engagement with the drive chain, this results in the manual chain hoist being driven.

In one embodiment of the present invention, the drive sheave is provided with a stabilizer in the form of a stirrup. This stirrup extends from the drive sheave and is engaged by the foot of an operator. The operator's foot inserted into the stirrup tends to stabilize the drive sheave and the entire portable drive assembly. In one embodiment of the present invention, the stabilizer takes the form of an elongated elastomember that is connected, by hooks for example, to opposite ends of the drive shaft that extends through the drive sheave.

In a particular embodiment of the present invention, the drive sheave is constructed of a relatively lightweight material such as nylon. This contributes to the lightweight and portability of the entire drive assembly. To provide a smooth driving operation, the chain cavity formed around the drive sheave can be faced with a rubber or resilient material such as neoprene.

Other advantages of the present invention will become apparent and obvious from a study of the following description and the accompanying drawings which are merely illustrative of such invention.

DETAILED DESCRIPTION OF THE INVENTION

With further reference to the drawings, the portable drive assembly of the present invention as shown therein and indicated generally by the numeral 10. This portable drive assembly 10 is particularly designed to work in conjunction with a manual chain hoist indicated generally by the numeral 12. As will be appreciated by subsequent portions of this disclosure, the portable drive assembly 10 is designed to be brought into engagement with the chain hoist and to electrically drive the same.

Figure 1:
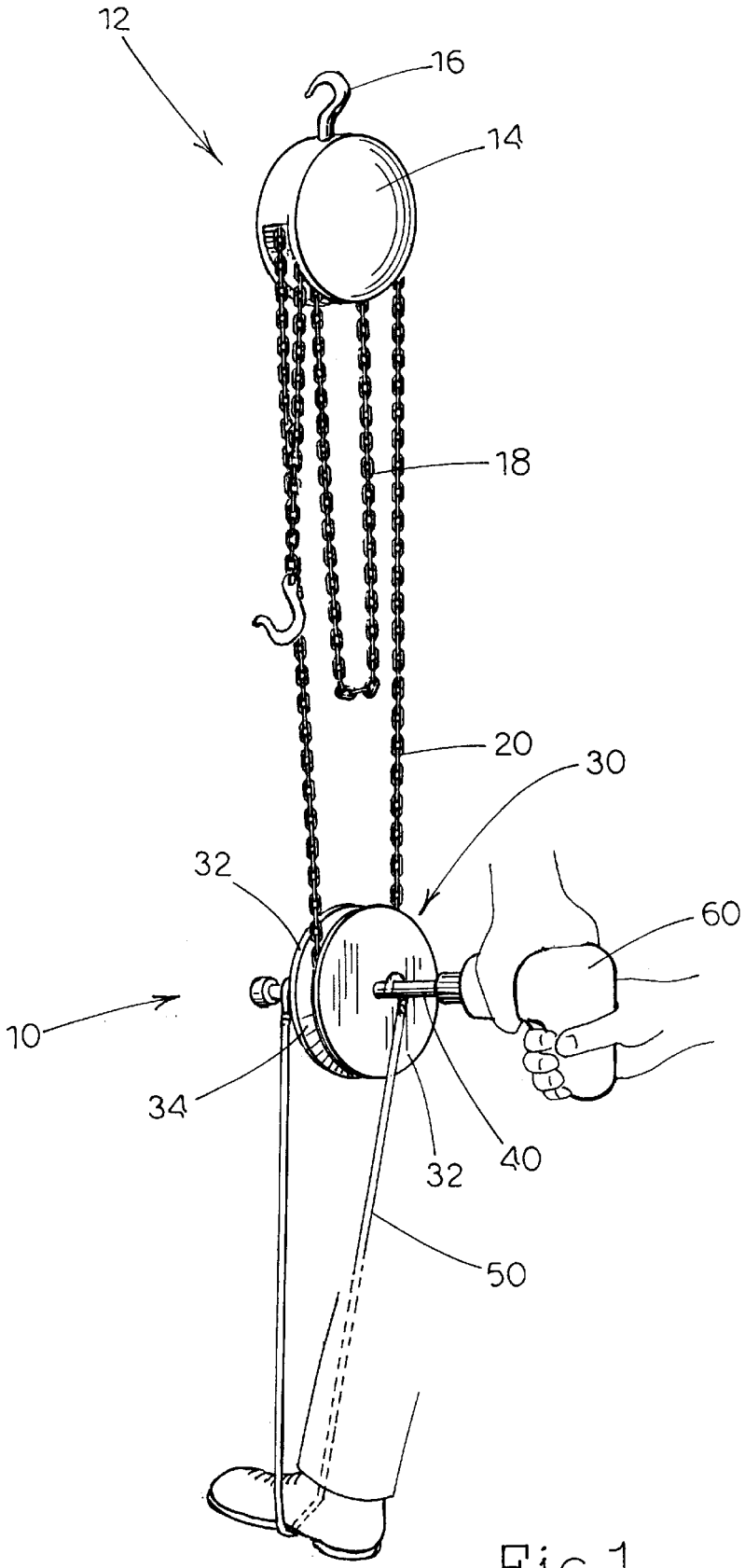
FIG. 1 is a perspective view of the portable drive assembly of the present invention showing the same being used to drive a manual chain hoist.
Figure 3:
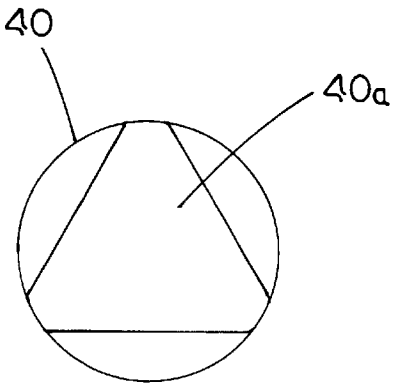
FIG. 3 is an end elevational view of the drive shaft for the sheave.

Viewing the chain hoist 12, as seen in FIG. 1, the same includes an upper housing 14 having a hook 16 that is designed to connect to a support structure that supports the chain hoist. The chain hoist is a manual chain hoist and in conventional fashion includes a load chain 18 and a drive or pull chain 20. Those skilled in the art will appreciate that the load chain 18 and drive chain 20 are interconnected by a conventional reduction gear network (not shown). Effectively, the connecting gear network provides a mechanical advantage that enables one to pull the drive chain 12 and in the process lift or lower very heavy loads. Details of the chain hoist 12 are not dealt with herein in detail, because such is not per se same material to the present invention and further manual chain hoists of the type disclosed herein are well known and appreciated by those skilled in the art.

Turning to the portable drive assembly 10, it is seen the same includes a drive sheave indicated generally by the numeral 30. Drive sheave 30 is adapted to engage a lower run or lower turn of the drive chain 12 of the chain hoist and to drive the same. Viewing the draft sheave 30 it is seen that the same includes a pair of opposed flanges 32 that include inner walls that generally taper to form a chain cavity 34 disposed between the flanges 32. Chain cavity 34 receives the drive chain 20 of the chain hoist when the drive sheave 30 is used to drive the chain hoist.

Figure 2:
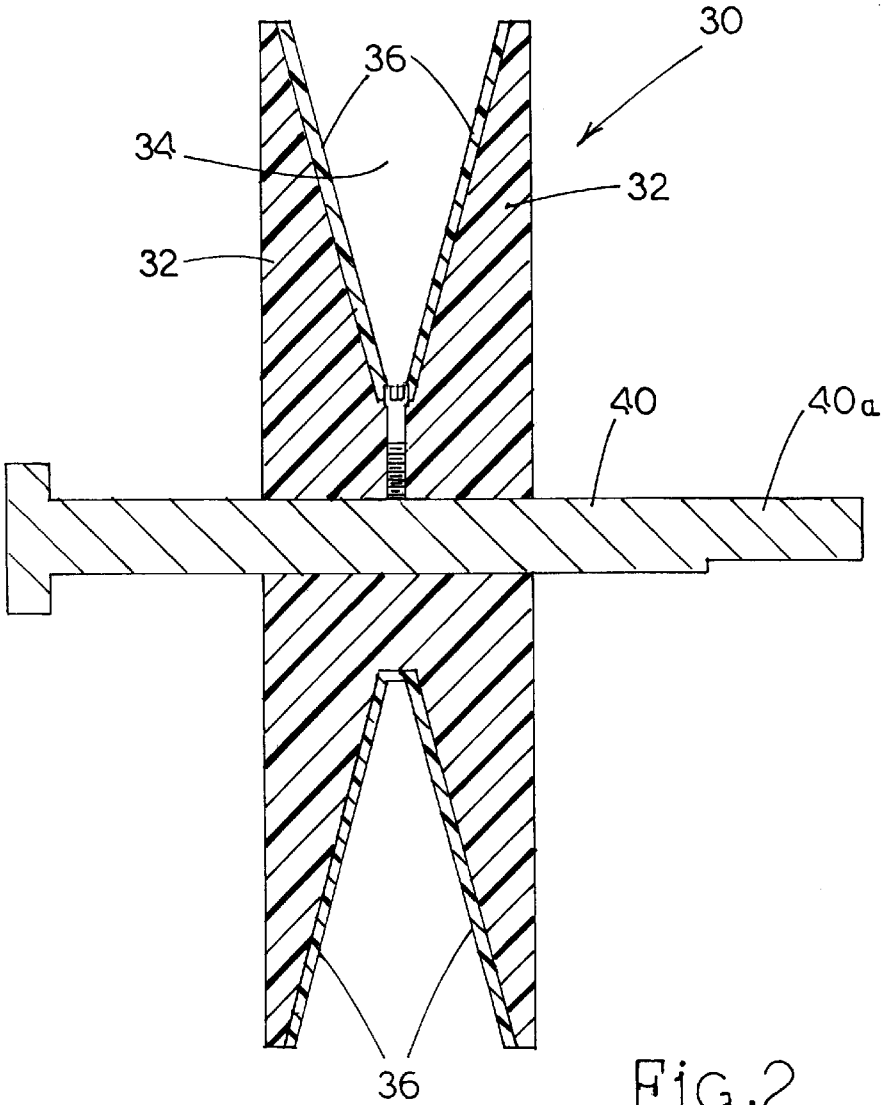
FIG. 2 is a sectional view of one embodiment of the drive sheave of the present invention.

In one embodiment of the present invention, the drive sheave 30 is constructed of a lightweight and strong material such as nylon, for example. To promote a smooth running sheave and to provide for wear, the chain cavity 34 can be at least partially faced with a rubber or resilient material such neoprene. This is indicated in FIG. 2 by the numeral 36. The rubber or resilient facing 36 extends upwardly from the hub portion of the drive sheave along the inner sides of the flanges 32. Thus it is appreciated that when the drive sheave 30 engages the drive chain 20, as suggested in FIG. 1, the rubber or resilient facing 36 acts as a surface that frictionally engages the drive chain 20.

Extending through the drive sheave 30 is a draft shaft 40. It is appreciated that the sheave 30 would include a central bore and the drive shaft would extend therethrough and be fixed therein. To fix the drive shaft 40 within the drive sheave 30, there may be provided one or more circumferentially spaced threaded bores formed in the hub of the drive sheave. An Allen screw or other type of fastener or screw can be screwed downwardly through these threaded bores into engagement with the drive shaft 40 so as to fixedly secure the drive shaft within the drive sheave 30.

As shown in the drawings, the drive shaft 40 extends completely through the drive sheave and includes opposed end portions that project outwardly from the drive sheave. One end portion is referred to by 40*a* and that portion of the drive shaft about the end is formed into a multi-sided (in this embodiment, three-sided) shaft that is particularly shaped and configured to fit a conventional chuck of an electric drill. As will be appreciated from subsequent portions of this disclosure, this end of the drive shaft is adapted to fit within an electric drill that forms a part of the portable drive assembly 10. Disposed on the opposite side of the drive shaft 40 is a bolt head or stop.

The portable drive assembly 10 is provided with a stabilizer that can be utilized to stabilize the entire drive assembly when the same is being used to power the chain hoist 12. In the case of the embodiment illustrated herein, the stabilizer is shown in the form of an elongated elastomember 50 that in this case assumes the form of a bungee cord. This elastomember 50 includes a pair of opposed hooks disposed on opposite ends. These hooks are designed to hook around the opposed ends of the drive shaft 40 that project from opposite sides of the drive sheave 30. By extending the elastomember 50 downwardly there is provided a stirrup for the operator to engage. More particularly, the operator can insert his or her foot into the stirrup formed by the elastomember 50 and stretch the same downwardly to the ground or to another underlying surface while the sheave is engaged with the lower run of the drive chain 20 as shown in FIG. 1. Thus, it is appreciated that the elastomember 50 can be utilized to hold and stabilize the drive sheave 30 and more particularly the entire portable drive assembly 10 when it is being used to drive the chain hoist.

To provide power to the drive sheave 40 and to drive the chain hoist 10 there is provided a conventional hand-held power drill indicated by the numeral 60. Drill 60 includes a conventional chuck and that chuck is designed to receive and hold the multisided end portion 40*a* of the drive shaft. Thus, by actuating the drill, the drive sheave 30 is rotated and that in turn drives the drive chain 20 of the chain hoist 12. It is appreciated that the portable drill 60 could be of any conventional horsepower and would generally be reversible. This would, of course, permit the load chain 18 of the chain hoist to be raised or lowered. The drill 60 could be electric, pneumatic, battery powered or any other type.

As seen in FIG. 1, the stabilizer 50 can be extended downwardly and held by the operators foot while the operator hold and controls the electric drill 60 that includes the drive sheave 30 connected thereto. Thus because the drive chain may raise and lower during operation, the elastomember 50 will stretch and contract so as to maintain the drive sheave 30 in a stable and secure position.

It is appreciated that the portable drive assembly 10 has many advantages. One advantage is that the entire assembly is of a lightweight construction that enables the same to be easily transported from one location to another. Thus, this feature of the present invention is particularly useful for individuals that have to move from one location to another location to operate a chain hoist. In fact, the design of the portable drive assembly is such that it can be easily handled and transported in a car or vehicle or even on a commercial airline.

The portable power assembly 10 of the present invention in combination with a manual chain hoist can be used for many different operations. Further, the portable drive assembly is easy to use and is effective to drive the drive or pull chain at even a variable speed, as the portable electric drill 60 would normally be of a variable speed type.

The present invention may, of course, be carried out in other specific ways than those herein set forth without departing from the spirit and the essential characteristics of the invention. The present embodiments are therefore to be construed in all aspects as illustrative and not restrictive and all changes coming within the meaning and equivalency range of the appended claims are intended to be embraced therein.

What is claimed is:

1. A chain hoist and a portable drive assembly for driving the chain hoist comprising:
   a. a chain hoist having a drive chain and a load chain;
   b. a portable drive assembly for engaging and driving the drive chain of the chain hoist, the portable drive assembly including:
      i. a drive sheave for engaging and driving the drive chain of the hoist;
      ii. a drive shaft extending from the drive sheave;
      iii. the drive sheave being constructed of nylon and having an open chain cavity is faced with a rubber material that engages the drive chain as the sheave is driven;
      iv. a power drill connected to the drive shaft for driving the drive sheave; and
      v. a stabilizer connected to the drive shaft and extending therefrom for stabilizing the drive sheave when the drive sheave is used to drive the drive chain, the stabilizer including an elongated elastomember that forms a stirrup such that an operator can insert a foot in the stirrup and effectively stabilize the drive sheave while the same drives the drive chain of the chain hoist.

2. The chain hoist and portable drive assembly of claim 1 wherein the drive shaft extends completely through the drive sheave and includes a driven end that is multi-sided for fitting within a drill chuck associated with the electric drill.

3. The chain hoist and portable drive assembly of claim 2 wherein the elastomember includes hooks disposed on opposite ends thereof for hooking around the drive shaft that extends through the drive sheave.

4. The chain hoist and portable drive assembly of claim 3 wherein the drive shaft includes a stop formed on the end thereof opposite the end that connects to the electric drill and wherein the stop effectively confines one hook of the elastomember on the drive shaft.

5. A portable drive assembly for driving the drive chain of a chain hoist comprising: a drive sheave for engaging and driving the drive chain of the hoist; a drive shaft extending from the drive sheave; a power drill for connecting to the drive shaft for driving the drive shaft and driving the drive sheave; and a stabilizer extending from the portable drive assembly for stabilizing the same, the stabilizer including a stirrup for receiving the foot of the operator.

6. The portable drive assembly of claim 5 wherein the stirrup is formed by a flexible elongated elastomember that connects across the drive shaft.

7. The portable drive assembly of claim 5 wherein the drive shaft extends completely through the drive sheave and includes opposed ends with one end being of a multi-sided construction for fitting a chuck assembly associated with the electric drill.

8. The portable drive assembly of claim 5 wherein the drive sheave includes a chain drive cavity that extends around the sheave and wherein there is provided a facing made of rubber that lines a portion of the drive chain cavity.

9. A method of driving the drive chain of a manual chain hoist comprising: connecting a portable power drill to a drive sheave that is capable of engaging the drive chain of the chain hoist and driving the chain hoist; moving the drive sheave into driving engagement with the drive chain of the hoist; actuating the power electric drill, causing the drive sheave to turn and drive the drive chain of the hoist, resulting in a load chain of the hoist being moved; and extending a stabilizer from the drive sheave to form a stirrup and inserting the foot of the operator into the stirrup so as to stabilize the drive sheave while the same drives a drive chain of the hoist.

10. The method of claim 9 wherein the stirrup is formed by an elongated elastomember having a pair of ends with each end having a hook formed thereon and wherein the hooks are connected to a drive shaft that extends through the drive sheave.

11. The method of claim 9 wherein the drive sheave is a floating drive sheave that floats up and down within a curved run of the drive chain of the hoist as the portable power drill turns the drive sheave.

12. The method of claim 9 wherein there is provided a drive shaft that extends through the drive sheave and includes an end portion that is connected within a chuck that forms a part of the electric drill.

* * * * *